US005906231A

United States Patent [19]

Rautio

[11] Patent Number: 5,906,231

[45] Date of Patent: May 25, 1999

[54] KNIFE INSERT FOR A WOOD-WORKING MACHINE

[76] Inventor: Kauko Rautio, Kolmihaarantie 1, FIN-5700 Mäntyharju, Finland, 52700

[21] Appl. No.: 08/879,570

[22] Filed: Jun. 20, 1997

[30] Foreign Application Priority Data

Jul. 8, 1996 [FI] Finland ..... 962788

[51] Int. Cl.[6] ..... B27G 13/00

[52] U.S. Cl. ..... 144/241; 144/218

[58] Field of Search ..... 144/162.1, 176, 144/218, 235, 232, 228, 236, 241

[56] References Cited

U.S. PATENT DOCUMENTS 4,263,949 4/1981 Kivimaa ..... 144/235
4,499,934 2/1985 Rautio ..... 144/176

FOREIGN PATENT DOCUMENTS 751911 8/1978 Finland .

*Primary Examiner*—W. Donald Bray
*Attorney, Agent, or Firm*—Baker & Botts, L.L.P.

[57] ABSTRACT

The present invention concerns a knife insert (1) for a wood-working machine, said knife insert being intended for mounting on a rotatable knife head, said knife insert having a first cutting edge (2) and a second cutting edge (3), the latter being arranged to cut obliquely to the grain of the wood stock, whereby said knife insert is adapted mountable to said knife head by its heel (4), which is the part of the insert situated closer to the center axis of the knife head than said first cutting edge (2). The first cutting edge (2) and the second cutting edge (3) are located relative to each other so that the second cutting edge (3), which cuts obliquely on the grain of stock, under all conditions hits the surface of the stock to be worked earlier than the first cutting edge (2).

5 Claims, 2 Drawing Sheets

KNIFE INSERT FOR A WOOD-WORKING MACHINE

BACKGROUND OF THE INVENTION

1. Field of the Invention

The present invention relates to a knife insert in accordance with the preamble of claim 1.

2. Description of the Prior Art

Logs to be sawn are usually worked at least on one side, however, most generally on two sides prior to rip-sawing. This operation is normally performed through milling certain side parts of the log into chips by passing the log into a gap formed by two revolving cutter heads. In the art are used knife heads shaped as a truncated cone and having knife inserts mounted thereto staggered in screw-thread fashion, whereby the side of the log will be chipped sequentially by each knife insert at a time starting from the outermost perimeter of the cutter head and proceeding radially toward the axis of revolution of the cutter head. Square timber hewing machines, chipping canters and similar wood-working machines generally have at least two cutter heads with a number of knife inserts attached to their perimeter in a spiralling succession so as form a screw thread. One such knife head is described in U.S. Pat. No. 4,499,934. Therein, each of the knife inserts mounted on the knife head has two cutting edges, of which one is arranged to cut approximately with the grain of stock (i.e., approximately longitudinally with the grain in at least some plane perpendicular to the working direction), while the other edge cuts obliquely to the grain. The knife insert is mounted on the knife head by its heel, which is formed by the extension of the with-the-grain cutting edge toward the center axis of the knife head. Such a knife insert has been developed further by aligning the obliquely-cutting edge at an outward pointing angle with respect to the with-the-grain cutting edge. One embodiment of this type of knife insert is described in a data sheet HewSaw R250 released by Veisto-Rakenne Rautio Oy, Finland.

Knife inserts of the prior-art technology have, however, been found to be problematic in cases where the knife insert runs in a small radius of rotation cutting the grain at an unfavourable angle. Such a situation is encountered when, e.g., a knife insert mounted on a small-diameter knife head is used for working large trunks. Then, the with-the-grain cutting edge starts to flex the cut chip outward before the cross-the-grain cutting edge has cut the wood grain. Resultingly, the chips will be of different sizes, which causes lower quality of the chips and other defects.

SUMMARY OF THE INVENTION

It is an object of the present invention to provide a knife insert which is free from the above-mentioned and other problems.

The invention is characterized by what is stated in the appended claims.

Owing to its uncomplicated operation, the knife insert according to the present invention is superior to conventional techniques. The quality of chips is improved, whereby the economical value of chips becomes higher. The goal of the invention is attained by means of a tip edge arranged to cut the grain of the stock before the first cutting edge has detached the chip from the stock.

BRIEF DESCRIPTION OF THE DRAWINGS

In the following, the invention will be described in greater detail with the help of an exemplifying embodiment by making reference to the appended drawings in which FIG. 1 (*a*) is a side view of a knife insert according to the invention;

FIG. 1 (*c*) is the knife insert of FIG. 1 (*a*) viewed from the direction of arrow c;

FIG. 1 (*d*) is the knife insert of FIG. 1 (*b*) viewed from the direction of arrow d;

FIG. 1 (*e*) is the knife insert of FIG. 1 (*a*) viewed from the direction of arrow e;

FIG. 1 (*f*) is the knife insert of FIG. 1 (*a*) viewed from the direction of arrow f;

DETAILED DESCRIPTION OF THE INVENTION

Figure 1A:
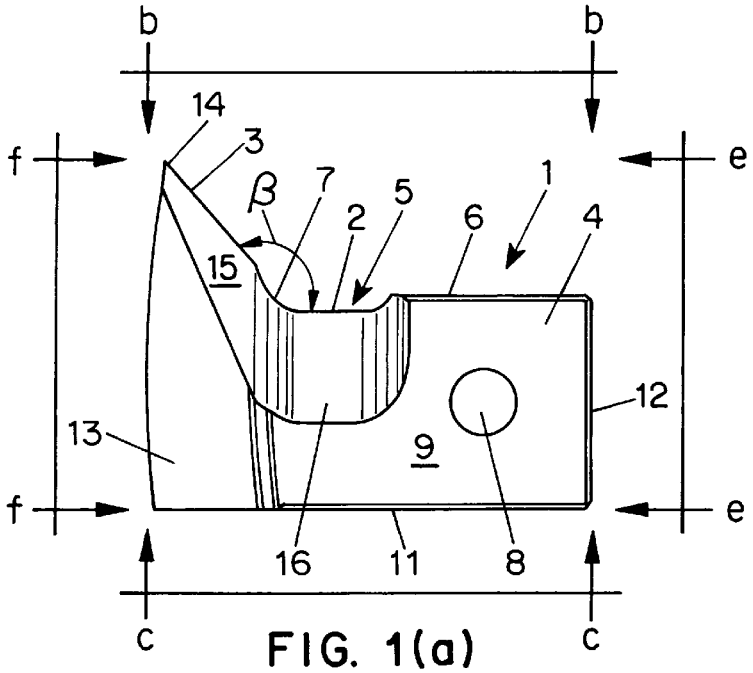
FIG. 1 (*b*) is the knife insert of FIG. 1 (*a*) viewed from the direction of arrow b.
Figure 1B:
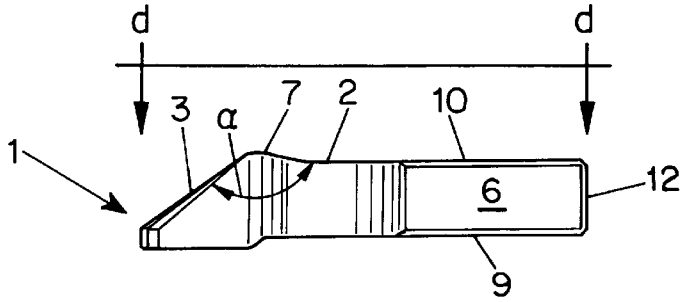
Figure 1E:
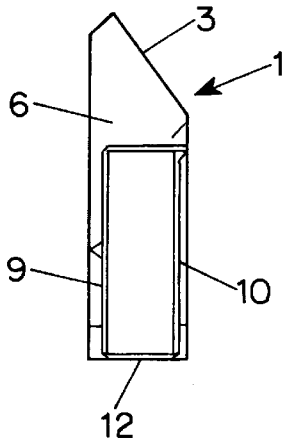
Figure 1C:
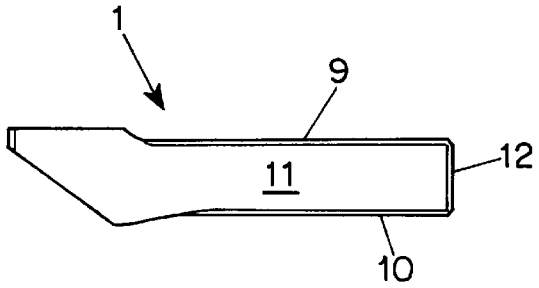
Figure 1F:
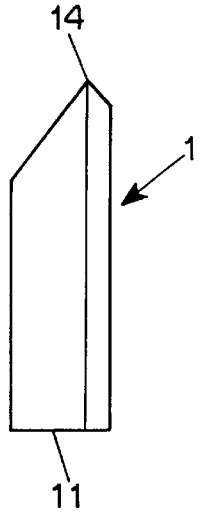
Figure 1D:
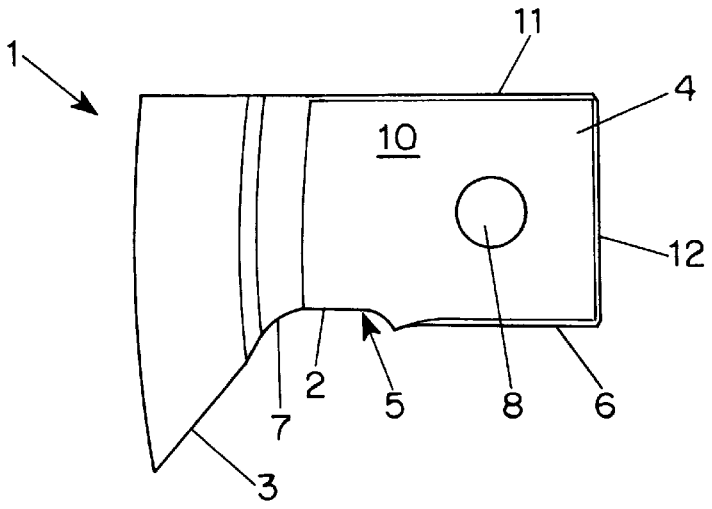
Figure 2:
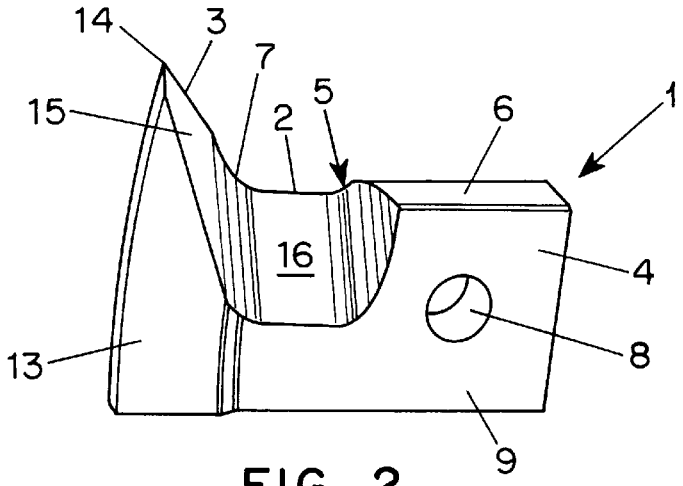
FIG. 2 is a perspective view of the knife insert according to the invention.
Figure 3:
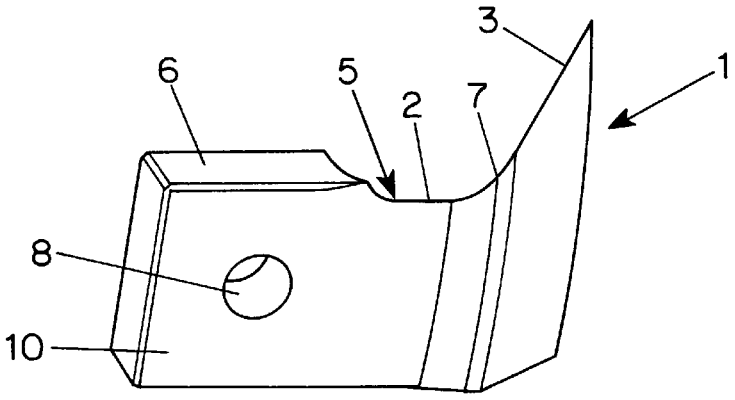
FIG. 3 is a perspective view of the knife insert shown from the opposite side with respect to the view of FIG. 2.

Referring to the diagrams, therein is shown a knife insert 1 for a wood-working machine, said knife insert being intended for mounting on a rotatable knife head, said knife insert having a first cutting edge 2 and a second cutting edge 3, the latter being arranged to cut obliquely to the grain of the wood stock, whereby said knife insert is adapted mountable to said knife head by its heel 4, which is the part of the insert situated closer to the center axis of the knife head than said first cutting edge 2. The first cutting edge 2 and the second cutting edge 3 are located relative to each other so that the second cutting edge 3, which cuts obliquely on the grain of stock, under all conditions hits the surface of the stock to be worked earlier than the first cutting edge 2.

In a typical case, the first cutting edge 2 is arranged to cut essentially longitudinally with the grain of stock.

In the case illustrated in the diagrams, the knife insert is provided with a notch 5 at the first cutting edge 2, whereby the cutting edge 2 is sunken at a depth from the plane of that side edge 6 of the insert heel 4 to which the first cutting edge is machined. By means of the notch 5, the cutting edges 2, 3 are arranged at such a distance from each other that the first one of the two cutting edges of the knife insert to hit the stock being machined is the second cutting edge 3, which is arranged to cut obliquely to the grain, and only thereafter, the first cutting edge 2 will meet the stock.

In the direction of knife insert rotation, the knife insert illustrated in the diagrams is provided with a pointed projection extending obliquely radially outward from the first cutting edge 2, whereby the second cutting edge 3 is machined to the edge of the pointed projection angled from the first cutting edge 2. Herein, the second cutting edge 3 advantageously forms an obtuse angle $\alpha$ with the first cutting edge 2 in the plane orthogonal to the plane of rotation of the knife insert. In the plane of rotation of the knife insert, the first cutting edge 2 and the second cutting edge 3 form an angle $\beta$, which advantageously is an obtuse angle. Advantageously, the second cutting edge 3 ends at a tapered tip 14 of the knife insert.

Advantageously, between the first cutting edge 2 and the second cutting edge 3 is arranged an essentially curved transition region 7. Both cutting edges 2, 3 are provided with a slanted rear surface 15, 16 on that side of the edges opposite to the stock being worked.

The knife insert is mounted in a conventional manner to the knife head by means of a fixing element such as a screw inserted through a hole 8 made to the heel 4 of the knife insert. Detailed discussion of the knife head and its use is omitted herein. Such practical arrangements can be assumed to be familiar to a person versed in the art and their closer description may be found in the publications mentioned in the part of this application related to the prior-art.

A knife head equipped with inserts according to the invention has given significant improvements in the quality of chips.

To a person versed in the art, it is obvious that the invention is not limited by exemplifying embodiment described above, but rather, can be varied within the scope and spirit of the appended claims.

What is claimed is:

1. A knife insert adapted to be mounted on a rotatable knife head of a wood-working machine, the rotatable knife head having a center axis and the wood-working machine being adapted to cut chips from wood stock having a grain and a surface, said knife insert comprising:

(a) a heel portion adapted to permit mounting of said knife insert on the knife head;

(b) a first cutting edge located outwardly from said heel portion with respect to the center axis of the knife head and arranged to cut with the grain; and (c) a second cutting edge located outwardly of the first cutting edge with respect to the center axis of the knife head and arranged to cut obliquely to the grain, said second cutting edge being located relative to said first cutting edge such that said second cutting edge hits the surface of the wood stock earlier than said first cutting edge.

2. The knife insert of claim 1, wherein a notch is defined in said knife insert at said first cutting edge so that said first cutting edge is recessed from said second cutting edge.

3. The knife insert of claim 1, wherein said heel portion has a side edge defining a side edge plane and said first cutting edge is recessed with respect to said side edge plane.

4. The knife insert of claim 3, wherein said second cutting edge forms an obtuse angle $\alpha$ with said first cutting edge in a plane that includes said side edge plane.

5. The knife insert of claim 4, wherein there is a curved transition region located between said first and second cutting edges.

* * * * *